US007017864B2

(12) United States Patent
McAllister

(10) Patent No.: US 7,017,864 B2
(45) Date of Patent: Mar. 28, 2006

(54) RAILWAY TRACK CIRCUITS

(75) Inventor: Lawrence Lawson McAllister, Chippenham (GB)

(73) Assignee: Westinghouse Brake and Signal Holdings Limited, Wilts (GB)

( * ) Notice: Subject to any disclaimer, the term of this patent is extended or adjusted under 35 U.S.C. 154(b) by 0 days.

(21) Appl. No.: 10/301,012

(22) Filed: Nov. 21, 2002

(65) Prior Publication Data

US 2003/0112131 A1 Jun. 19, 2003

(30) Foreign Application Priority Data

Nov. 21, 2001 (GB) ..... 0127927

(51) Int. Cl.
*B61L 21/00* (2006.01)

(52) U.S. Cl. ..... 246/34 R

(58) Field of Classification Search ..... 246/20, 246/34 R, 122 R, 122 A, 125, 128
See application file for complete search history.

(56) References Cited

U.S. PATENT DOCUMENTS

| | | | | |
|---|---|---|---|---|
| 4,015,082 A * | 3/1977 | Matty et al. | ..... | 701/20 |
| 4,065,081 A | 12/1977 | Huffman et al. | | |
| 4,498,650 A | 2/1985 | Smith et al. | | |
| 4,582,279 A | 4/1986 | Pontier | | |
| 4,737,968 A * | 4/1988 | Norton et al. | ..... | 375/297 |
| 4,855,737 A | 8/1989 | Poole | | |
| 5,590,855 A * | 1/1997 | Kato et al. | ..... | 246/202 |
| 6,011,508 A * | 1/2000 | Perreault et al. | ..... | 342/350 |
| 6,220,552 B1 * | 4/2001 | Ireland | ..... | 246/122 R |

FOREIGN PATENT DOCUMENTS

| | | |
|---|---|---|
| CA | 1149918 A | 7/1983 |
| EP | 0165048 A2 | 12/1985 |
| EP | 0 878 373 A2 | 11/1998 |
| GB | 1 546 942 | 5/1979 |
| SU | 1592204 A | 9/1990 |
| WO | WO-91/11356 A1 | 8/1991 |

OTHER PUBLICATIONS

Lionti et al., Wireless transmissions in multipath environments benefit from direct sequence spread spectrum techniques, IEEE, ETFA 2001, Conference Proceedings, vol. 2, Oct. 15-18, 2001, pp. 169-178, France.

European Search Report dated Apr. 25, 2003 from corresponding European Application No. 02257285.3-2215-, (3 pages).

* cited by examiner

*Primary Examiner*—Sherman Basinger
*Assistant Examiner*—Robert J. McCarry, Jr.
(74) *Attorney, Agent, or Firm*—Christie, Parker & Hale, LLP

(57) ABSTRACT

Railway track circuit apparatus for train detection comprises a track circuit transmitter and a receiver, wherein the transmitter generates a QPSK modulated signal that is transmitted into a track circuit and which is detected by the receiver.

8 Claims, 3 Drawing Sheets

RAILWAY TRACK CIRCUITS

CROSS-REFERENCE TO RELATED APPLICATION(S)

This application claims priority of United Kingdom Patent Application No. 0127927.2, filed Nov. 21, 2001.

BACKGROUND OF THE INVENTION

The present invention relates to railway track circuits.

Track circuits are a well-established means of train detection and can also be used to provide a level of broken-rail detection. A fundamental difficulty with track circuits on modem electrified railways is that they must share the railway track with the traction return, and track circuits have consistently evolved to provide better immunity to interference from traction systems. Another key concern for track circuit signals is cross-coupling between tracks, which could result in one track erroneously accepting a signal from another track. Over recent history (the last 20 years) various track circuits have evolved that use Frequency Shift Keying (FSK) to form a distinct electrical signal that is transmitted along the track. EP-A-0 165 048 discloses a coded track circuit system using FSK as a carrier mechanism. Early FSK track circuits used relatively simple generators and receivers. Further enhancements have been made to such receivers to improve the discrimination of the FSK signal and to such transmitters to generate a more unique FSK signal.

Existing FSK systems use various FSK modulation techniques to develop a signal with some level of uniqueness from any other track circuit and from the signals generated in the traction return system.

Various modulation techniques for railway track circuits are also disclosed in WO 01/11356, U.S. Pat. No. 4,582,279, U.S. Pat. No. 4,498,650, U.S. Pat. No. 4,065,081, U.S. Pat. No. 4,015,082, SU-A-1592204 and CA-A-1 149 918.

SUMMARY OF THE INVENTION

According to the present invention, there is provided railway track circuit apparatus comprising a track circuit transmitter and a track circuit receiver, wherein the transmitter generates a QPSK modulated signal that carries a digital message which is transmitted into the track circuit and carries an indication of the identity of the track circuit, which signal is detected by the receiver, the receiver only indicating that the track circuit is clear having received a QPSK signal of sufficient amplitude and carrying the correct track circuit identity.

Preferably, the QPSK signal is constrained to a narrow frequency band to produce a QPSK signal with a high form factor. The QPSK modulated signal preferably is a differential form of a QPSK (QDPSK) modulated signal.

Preferably, the receiver only indicates that the track circuit is clear having decoded the QPSK signal and checked that the sum of all phase coherent symbol amplitudes in the message is greater than a predefined threshold.

The data transmitted in the QPSK signal could also carry internal transmitter information to the receiver. Such internal transmitter data could indicate the current transmitter output amplitude, which is used by the receiver to determine signal attenuation along the track circuit.

Data transmitted in the QPSK signal could be supplied to the transmitter from an external system (such as adjacent track circuit apparatus), transmitted along the track circuit and received by the track circuit receiver, which outputs the data to an external system (such as adjacent track circuit apparatus).

For track to train communication, the QPSK signal could also receivable by a train-borne receiver.

BRIEF DESCRIPTION OF THE DRAWINGS

The present invention will now be described, by way of example, with reference to the accompanying drawing, in which.

DETAILED DESCRIPTION OF THE INVENTION

In railway track circuit apparatus, the use of a Phase Shift Keying (PSK) modulation technique offers the generation and detection of a more unique signal, offering improved discrimination between a track circuit signal and interference from other tracks or the traction return system. Further, there are applications where it is also desirable to carry information along the track circuit to reduce the need for additional trackside communications or track-to-train communications and PSK offers an improved information rate for a given bandwidth, which facilitates this while still fulfilling a train detection role.

When a PSK signal is band-limited to a narrow band, the signal has a relatively high peak voltage in relation to the root mean square (RMS) voltage (high form factor) and thus for a given power driven into the track circuit, the signal provides a higher voltage for breaking down rail contamination.

Figure 1:
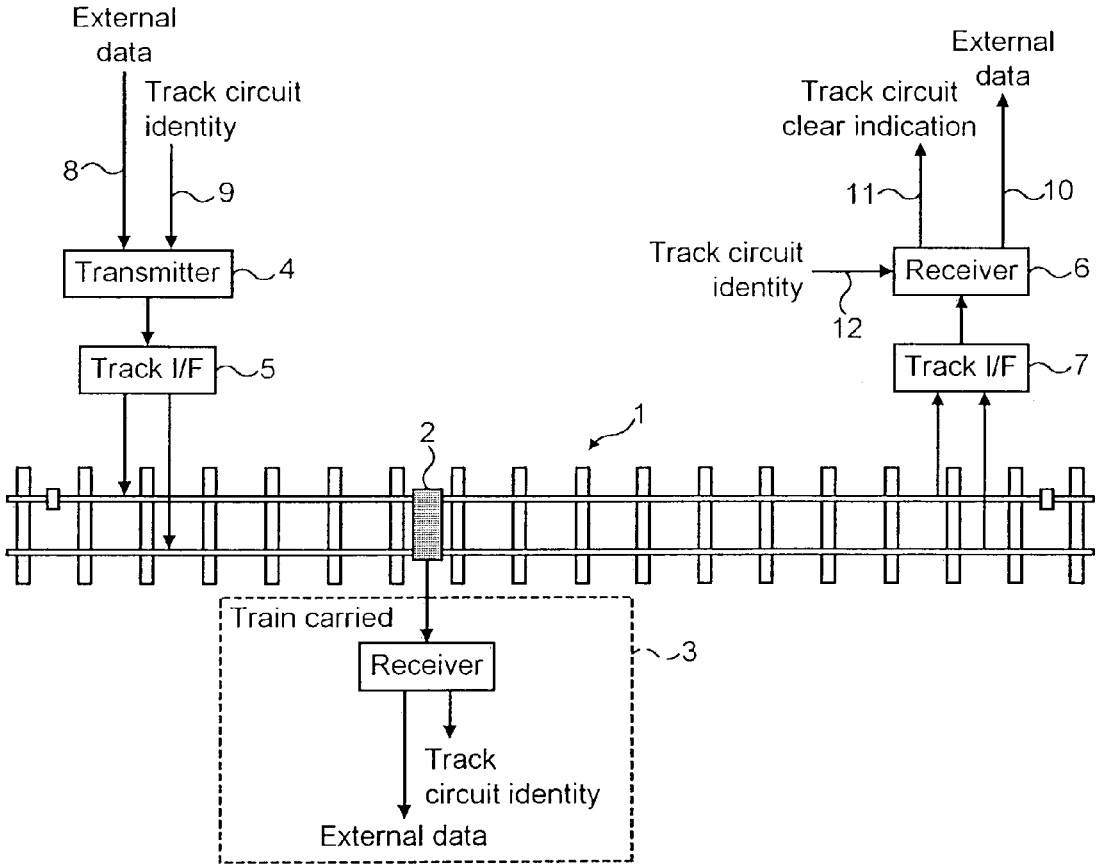
FIG. 1 is a block diagram of a system including an example of apparatus according to the present invention.

Referring first to FIG. 1, reference numeral 1 designates a length of railway track and reference numeral 2 schematically represents a train having train-carried equipment 3. To provide a track circuit, there are a transmitter 4 coupled with the track 1 via track interface circuitry 5 and, at or adjacent the other end of the track circuit, a receiver 6 coupled with the track 1 via track interface circuitry 7. In practice, there would be a series of such track circuits along the track 1 each associated with a respective section of track.

The transmitter 4 receives on an input 8 external data and on an input 9 an indication of the identity of the track circuit. The receiver 6 supplies on an output 10 external data, on an output 11 an indication of whether or not the track circuit is clear and receives at an input 12 an indication of track circuit identity.

The train-carried equipment 3 comprises a receiver 13 (typically having a structure the same as or similar to that of receiver 6) providing external data on an output 14 and an indication of track circuit identity on an output 15.

In the system of FIG. 1, there is the option of train pick-up of rail current by receiver 13. The differences compared to existing track circuits are the ability to carry more data between transmitter and receiver, thus enabling more unique track identities and the transfer of other data external to the track circuit system.

The transmitter 4 generates a unique signal that is coupled into the track 1 and propagates along the track to receiver 6. The unique signal carries a suitably modulated message (telegram) that is repeated on a cyclic basis. The message contains a track circuit identity unique to that track circuit within a given geographic area. Other external data may also be included, for example trackside communications information or information to a train on the track circuit.

The track circuit receiver 6 measures the amplitude of the unique signal and drives a track circuit clear output if the signal is of sufficient amplitude and the message contains the correct track circuit identity. As mentioned, the same basic receiver equipment may be used on a train to provide information from the track circuit.

In alternative configurations, the track circuit could be one in which a transmitter is between and communicating with two such receivers which are opposite each other; or the track circuit could be one which has two ends opposite the transmitter, with such a receiver at or adjacent each of these ends; or the track circuit could be the one which has three ends, with such a receiver at or adjacent each of the ends and such a transmitter communicating with each of the receivers.

The system benefits from a modulation scheme that provides good data rate in the potentially noisy track circuit environment. The present invention makes use of a Quadrature Phase Shift Keying (QPSK) modulation technique that offers the potential to transmit significant information. This high information rate facilitates larger track circuit identities that are unique over a large geographic area as well as larger data rates from transmitter(s) to receiver(s). Much of the implementation detail regarding Quadrature Phase Shift Keying and its communications features are well known to the communications industry. However, practical and safe application to train detection is novel.

In PSK communication systems, the information (data) is conveyed by a phase change in a carrier waveform. The available range of phase change is $2\pi$ radians. This is divided into an even number (M-array) of phase transitions, each transition representing a different information symbol (data value). Common numbers of phase transitions (M) are 2 (binary), 4 (Quadrature), 8, 16 and 32. The higher the order of phase transitions (M) the higher the error rate for a given signal to noise ratio (SNR). Quadrature PSK (QPSK) delivers good information rate and good noise tolerance essential in a track circuit. The noise performance of higher order PSK is unattractive in track circuits, particularly as the use of error correction techniques are not generally accepted in a safety critical system.

The generation, and especially the safe detection, of QPSK is made feasible in track circuits by modern digital signal processors (DSPs) and associated digital signal processing techniques.

Aspects of the system are:

- the same basic receiver equipment can be utilised on trains as is used at the track side;
- each track signal is QPSK encoded, which delivers good information capacity;
- the techniques used to generate and decode the track signal lend themselves to readily configuring the carrier frequency locally, and thus common transmitter and receiver equipment can be easily configured to provide various frequencies.

Figure 2:
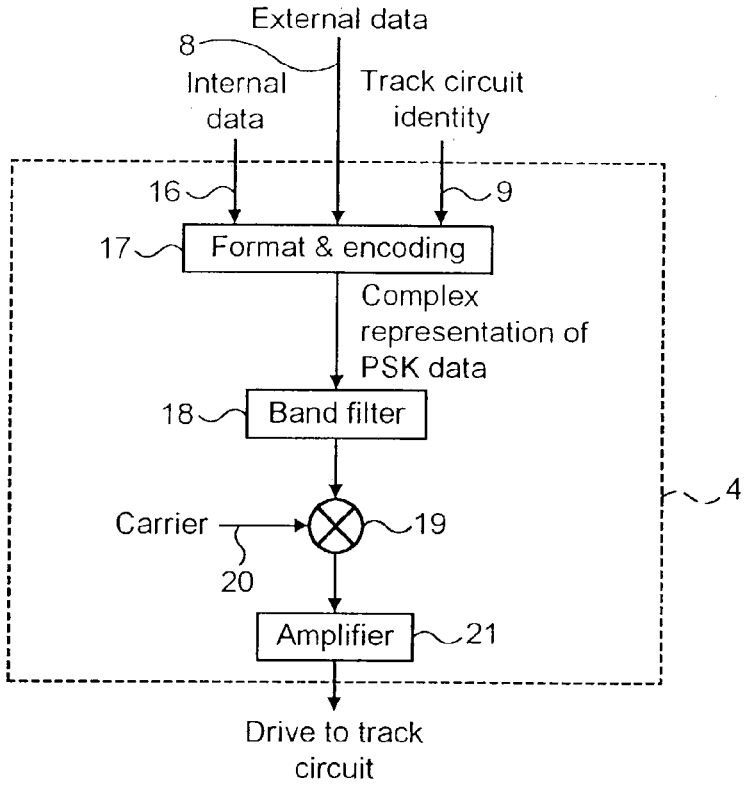
FIG. 2 is a block diagram of a transmitter of the apparatus.

Referring to FIG. 2, the transmitter 4 comprises a format and encoding module 17, receiving, as well as external data and an indication of track circuit identity, internal data on an input 16. The output of module 17, as a complex representation of QPSK data, is applied via a band filter 18 to a mixer 19 which receives a carrier on an input 20. The output of the mixer 19 passes via an amplifier 21 to the track interface circuitry 5.

The digital data to be transmitted is constructed in module 17 from the track circuit identity, internal data and external data. A parity word is added to the data to provide error detection and correction. The data is QPSK encoded and band-limited before being mixed with the carrier signal. The locally configured carrier frequency is mixed with the QPSK encoded data just prior to amplification and transmission, thus separating the coding from the carrier frequency and enabling easy configuration of the carrier frequency.

As well as the track circuit identity and other external data there can, as mentioned, be internal data. This internal data can be used to transmit the current transmitter amplitude to the receiver 6. This allows the receiver 6 to determine the attenuation of the signal along the track and use attenuation to determine if the track is clear. This ratiometric detection technique can be used to remove some of the signal generation and control tolerances in the transmitter.

The track circuit identity, external data and internal data are coded into a message with suitable error detection and synchronisation codes. The message is then converted into a string of symbols that are represented as two-dimensional vector quantities (complex numbers). The symbol vectors are converted to arrays of output samples that are then filtered giving a baseband representation of the QPSK signal.

The transmitter 4 uses substantial digital filters implemented in a DSP to tightly band-limit the QPSK signal. This is necessary to allow:

- different bands to be placed close together in frequency;
- permit maximum data rate in the available frequency band;
- the most important benefit to a track circuit is a high form factor for the track circuit signal. In other words, a relatively high peak voltage in relation to the RMS voltage of the transmitter output signal. This ensures that, for a given power driven into the track circuit, the signal provides a higher voltage for breaking down rail contamination than present FSK systems.

The baseband signal is finally mixed with the desired carrier frequency for the track circuit and amplified to deliver the power necessary to drive the track circuit. The mixing with the chosen carrier makes it relatively easy to configure the same product to provide various different carrier frequencies.

Figure 3:
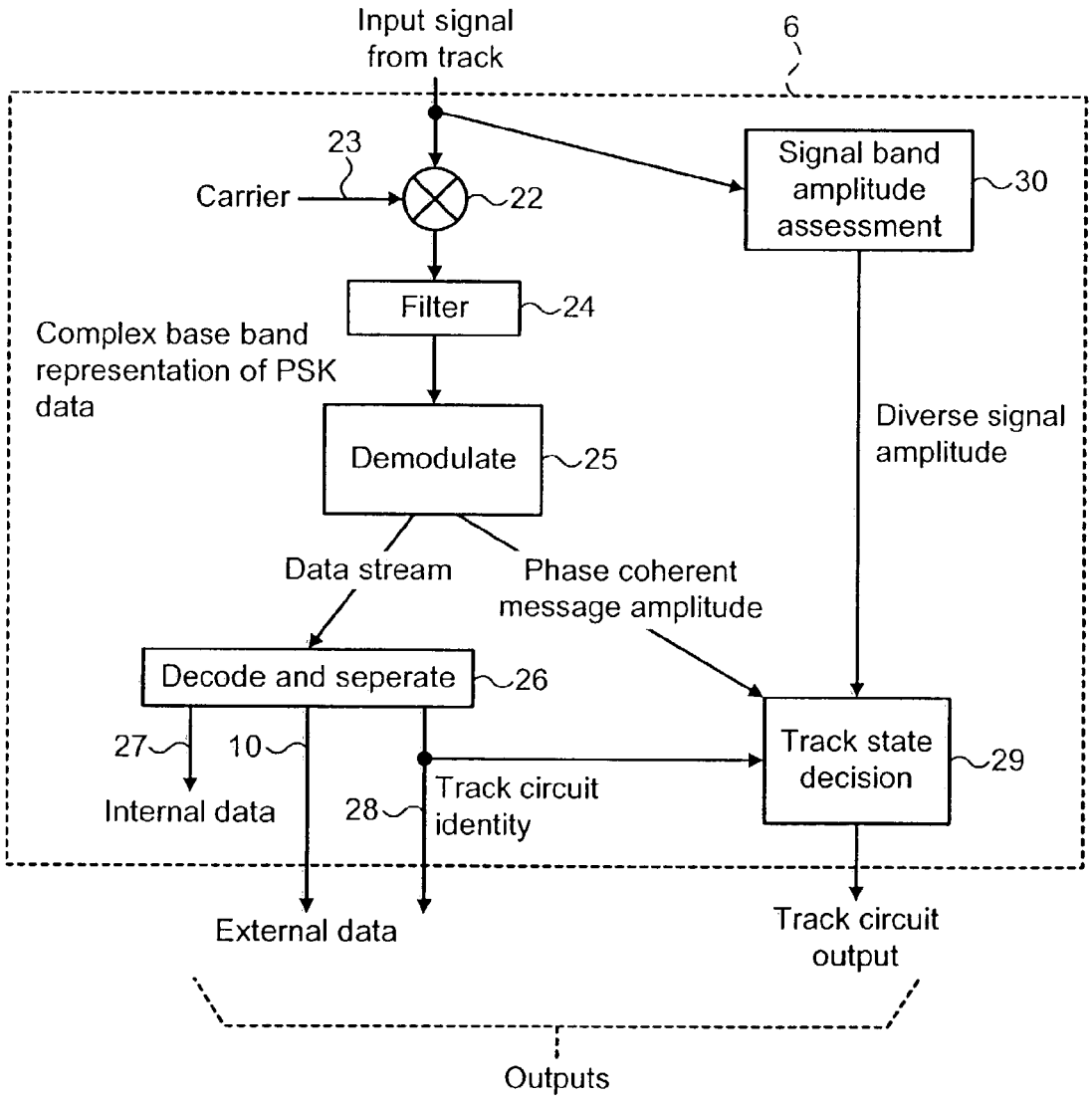
FIG. 3 is a block diagram of a receiver of the apparatus.

Referring to FIG. 3, the receiver 6 comprises a mixer 22 which receives a signal from the track and a carrier on an input 23, the output of mixer 22 being applied via a filter 24 to a demodulation module 25. The module 25 provides a data stream to a decoding and separation module 26 which provides the external data on output 10, internal data on an output 27 and track circuit identity on an output 28, the track circuit identity also being applied to a track state decision module 29. Track state decision module 29 also receives a diverse signal amplitude output from a signal band amplitude assessment module 30, which also receives the signal from the track, and a phase coherent symbol amplitude output from demodulation module 25.

The demodulation and decoding technique is the same for the receiver 6 and the receiver 13 of the train-carried equipment. The technique determines the track circuit identity, external data and internal data used in the operation of the track circuit.

The module 17 of FIG. 2 on the one hand and the modules 25, 26, 29 and 30 of FIG. 3 on the other hand could be implemented in software in each case in a single processor.

In the receiver 6, the incoming track signal is complex heterodyned at the chosen carrier frequency and filtered to remove higher frequency components. The resulting information is a complex representation of the baseband amplitude and phase information of the track signal. A suitable synchronising function is used to locate the centres of the symbols, which allows a vector quantity to be extracted for each symbol. The relative change in phase between consecutive symbol vectors defines the data, which with QPSK gives four potential values per symbol (i.e. the possible 360 degree phase shift is split into four areas). The data stream extracted from the incoming signal contains the track circuit identity, external data and internal data used in the operation of the track circuit.

It will be seen that the demodulation process delivers both data and phase coherent message amplitude. It is essential to enforce a strong relationship between the track code and the level of the track signal as this is critical to train detection safety. This is not a normal requirement for PSK communications systems.

Figure 4:
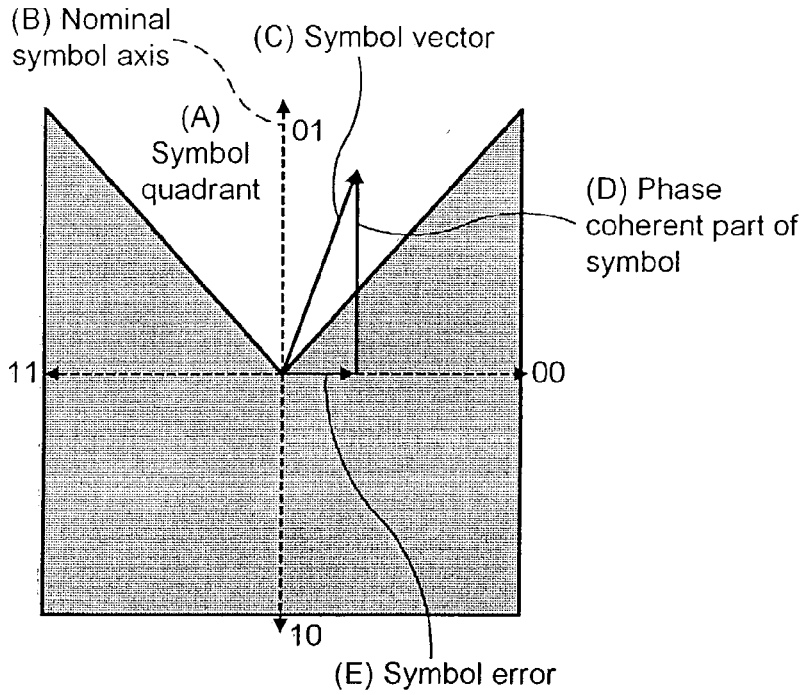
FIG. 4 is a vector diagram for use in explaining the receiver's demodulation technique.

The phase coherent amplitude is the sum of the phase coherent parts of each symbol. FIG. 4 illustrates what is meant by the phase coherent part of each symbol. In decoding each symbol, a decision has been taken as to which detection quadrant (A) the symbol vector lies in. The nominal symbol axis (B) of the signal vector for a particular symbol lies in the centre of the quadrant. The actual received symbol vector (C) will lie somewhere in the quadrant and what is required is the portion of that vector parallel to the nominal symbol axis. This may be calculated by considering the received symbol vector to consist of two vectors, one which is the phase coherent part (D) of the symbol, parallel to the nominal symbol axis, and the other which is the symbol error (E), perpendicular to the nominal symbol axis. Basic trigonometry allows the magnitude [D] of the phase coherent part of the symbol to be calculated.

A simpler and diverse calculation of in-band RMS amplitude is also carried out and used as a cross-check with the phase coherent amplitude to meet track circuit safety requirements. The track circuit clear decision is based on reception of the correct track circuit identity and adequate signal levels from both level assessment mechanisms.

In the above, a track circuit system is disclosed for railway train detection utilising a QPSK modulated track signal to carry significant track circuit identity coding and data from a transmitter to one or a plurality of receivers. The use of band-limited QPSK improves the form factor of the signal which offers increased peak track voltage for a given power. The increased data capacity allows much longer digital codes to be assigned to a track circuit thus providing higher security of the track signal in the presence of interference from other track circuits or from traction current. The increased data capacity can also be utilised to provide for the transfer of other data from the transmitter to other receivers.

What is claimed is:

1. A railway track circuit apparatus comprising a track circuit transmitter and a track circuit receiver, wherein the transmitter generates a QPSK modulated signal, which is transmitted into the track circuit, said signal carrying a digital message, and a unique track circuit identifier code, and wherein the QPSK modulated signal is detected by the receiver, the receiver only indicating that the track circuit is clear having received a QPSK modulated signal of amplitude greater than a threshold and carrying the correct track circuit identifier code.

2. The apparatus according to claim 1, wherein the QPSK signal is constrained to a narrow frequency band to produce a QPSK signal with a high form factor.

3. The apparatus according to claim 1, wherein the QPSK modulated signal is a differential form of a QPSK modulated signal, i.e. a QDPSK modulated signal.

4. The apparatus according to claim 1, wherein the receiver only indicates that the track circuit is clear having decoded the QPSK signal and checked that the sum of all phase coherent symbol amplitudes in the message is greater than a predefined threshold.

5. The apparatus according to claim 1, wherein the data transmitted in the QPSK signal also carries internal transmitter information to the receiver.

6. The apparatus according to claim 5, wherein the internal transmitter data indicates the current transmitter output amplitude, which is used by the receiver to determine signal attenuation along the track circuit.

7. The apparatus according to claim 1, wherein data transmitted in the QPSK signal can be supplied to the transmitter from an external system, transmitted along the track circuit and received by the track circuit receiver, which outputs the data to an external system.

8. The apparatus according to claim 1, wherein for track to train communication, the QPSK signal is also receivable by a train-borne receiver.

* * * * *